United States Patent [19]

Riba et al.

[11] Patent Number: 4,616,434

[45] Date of Patent: Oct. 14, 1986

[54] IRONING TABLE WITH MOUNTING FOR AN IRONING CLOTH

[75] Inventors: Günther Riba, Rosenbergstr. 26, D-5455 Hardert; Norbert Cebulla, Neuwied, both of Fed. Rep. of Germany

[73] Assignee: Günther Riba, Fed. Rep. of Germany

[21] Appl. No.: 772,383

[22] Filed: Sep. 4, 1985

[30] Foreign Application Priority Data

Sep. 10, 1984 [DE] Fed. Rep. of Germany ..... 3433170

[51] Int. Cl.[4] ..... D06F 81/14

[52] U.S. Cl. ..... 38/140; 2/DIG. 6; 108/90

[58] Field of Search ..... 38/140; 150/52 R; 108/90; 5/496; 297/DIG. 6

[56] References Cited

U.S. PATENT DOCUMENTS

| | | | |
|---|---|---|---|
| 826,748 | 7/1906 | Reeve | 38/140 |
| 1,158,279 | 10/1915 | Polski | 38/140 |
| 1,182,540 | 5/1916 | Edwards | 38/140 |
| 1,636,913 | 7/1927 | Kobrin | 38/140 |
| 1,651,427 | 12/1927 | Wegh | 38/140 |
| 1,926,429 | 9/1933 | Bendelari | 38/140 X |
| 2,504,560 | 4/1950 | McCrory | 38/140 |
| 3,181,259 | 5/1965 | Petrasch | 38/140 X |
| 3,324,584 | 6/1967 | Adiletta et al. | 38/140 |

*Primary Examiner*—Werner H. Schroeder
*Assistant Examiner*—Andrew M. Falik
*Attorney, Agent, or Firm*—Robert T. Gammons

[57] ABSTRACT

An ironing table comprises an ironing cloth to be stretched thereacross. In order to allow a faster replacement and fixing of the ironing cloth, the ironing table comprises a groove or slot at a first side thereof for engaging a first lateral edge of the ironing cloth and a Velcro fastening at the opposite second side of the ironing table for attaching the opposite second edge of the ironing cloth.

11 Claims, 5 Drawing Figures

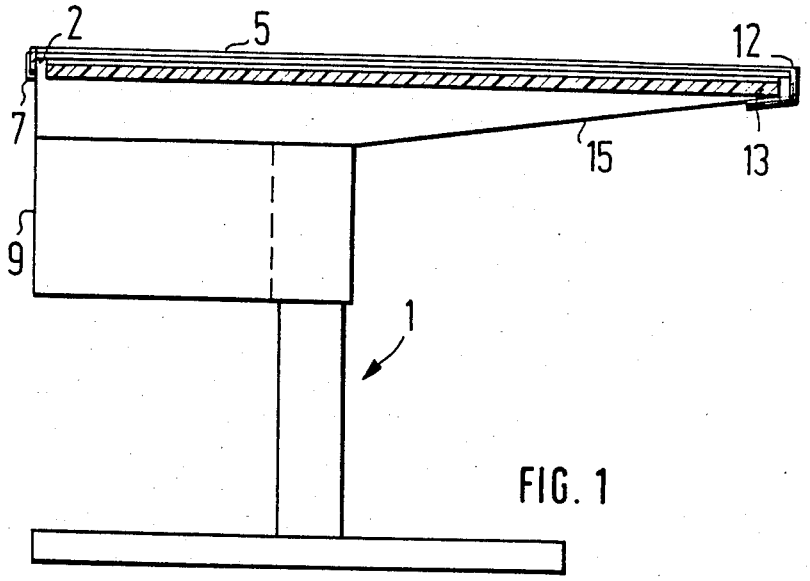
FIG. 1
FIG. 2
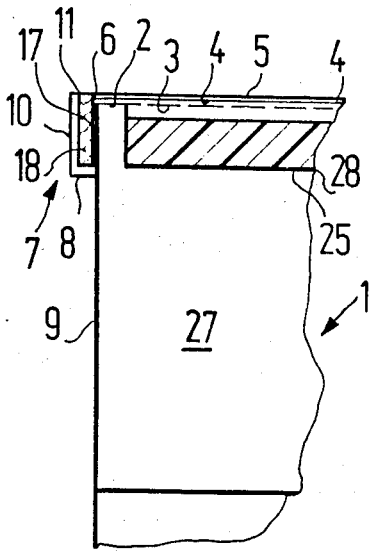
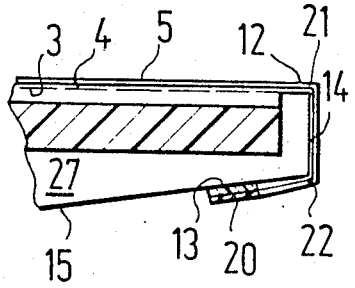
FIG. 3

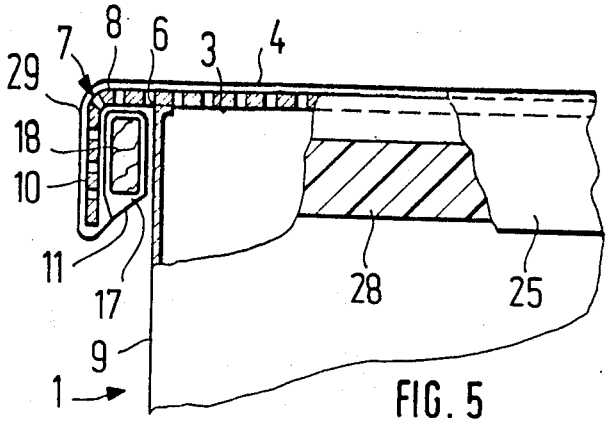
FIG. 5
FIG. 4
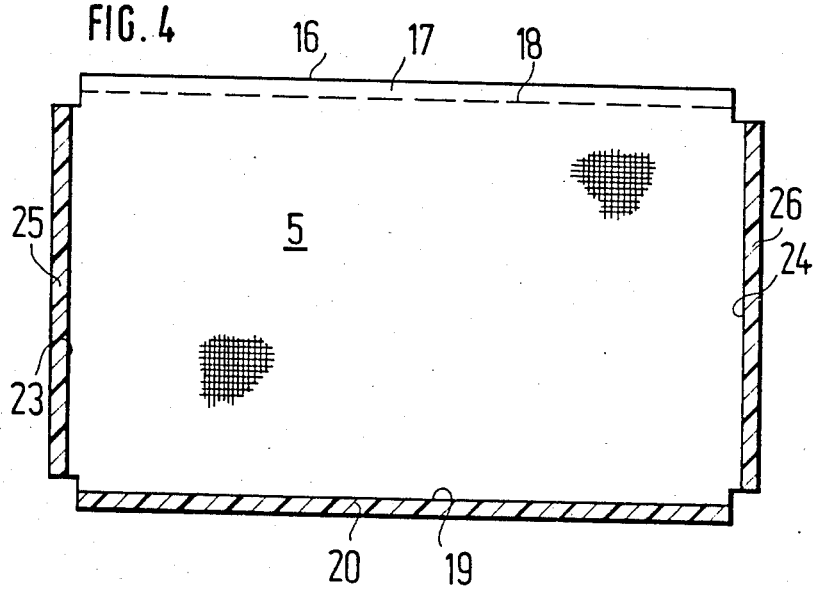

IRONING TABLE WITH MOUNTING FOR AN IRONING CLOTH

BACKGROUND OF THE INVENTION

The invention relates to an ironing table having a table surface, an ironing support and a mounting for an ironing cloth to be stretched thereacross.

For the actual use thereof, such ironing tables are generally covered with so-called ironing supports and ironing cloths. It is necessary that these covers are penetrable by air and heat resistant. As an example a cover consists of a silicone rubber foam of about 6 mm thickness having the actual ironing cloth stretched on top thereof which is as well formed of a heat resistant type of cloth. In order to facilitate the ironing operation as much as possible, it is desired to mount the stretched ironing cloth as smooth and tight as possible. It is known to mount the ironing cloth by means of a quick-stretch frame which surrounds the ironing table with an air gap therebetween and which is put over the material to be stretched. It may then happen with ironing supports and ironing cloths of varying thickness, that the frame either does not fit or does not provide a sufficient stability. Moreover, it is known to grip the cloth by means of laterally engaging hook-shaped claws which are tightened via springs. This leads to an ununiform tension.

OBJECTS OF THE INVENTION

It is one object of the invention to provide an improved ironing table. It is a further object of the invention to provide an ironing table with an improved mounting for the ironing cloth. It is a still further object of the invention to provide an ironing table allowing an unobjectionable stretching of an ironing cloth in an easy manner.

SUMMARY OF THE INVENTION

According to the invention the ironing table comprises a table surface, an ironing support and a mounting for an ironing cloth to be stretched thereacross and having a first lateral edge and an opposite second lateral edge, said mounting comprising engaging means for engaging said first lateral edge of said ironing cloth, said engaging means being located at a first side of said table surface, and a fixing means for fixing said opposite second lateral edge of said ironing cloth, said fixing means being located at a second side of said ironing table which is opposite to said first side.

BRIEF DESCRIPTION OF THE DRAWINGS

Further features, objects and advantages of the invention will stand out from the following description of the non-limitative examplary embodiments of the invention with reference to the drawings. In the drawings:

FIG. 1 is a lateral view of an ironing table;

FIG. 2 is a partly sectional lateral view of the apparatus of FIG. 1 in enlarged representation;

FIG. 3 is a view of the lateral region of FIG. 1 opposite to the one shown in FIG. 2 in enlarged representation;

FIG. 4 is a plan view onto the ironing cloth to be clamped from below in a scale differing from the one of FIG. 1; and FIG. 5 is a partly sectional representation corresponding to the one of FIG. 2 of a modified embodiment.

In conventional manner, the ironing table 1 has a table surface 2. A perforated metal sheet 3 and a silicone rubber layer 4 are disposed on the table surface 2. An ironing cloth 5 is provided on top of the silicone rubber layer 4.

Adjacent to an edge 6 of the ironing table or the table surface, respectively, an L-shaped angle piece 7 is mounted by fixing the lower leg 8 thereof to the side wall 9 adjacent to the edge 6, as may be best seen from FIG. 2. In this manner a groove or slit 11 having an open top side is formed between the vertical leg 10 of the angle piece 7 and the side wall 9.

Preferably, the L-shaped angle piece 7 is formed to extend substantially over the entire length of the side wall 9, whereby the inner surface of the vertical leg extends substantially parallel to the side wall 9. However, the L-shaped angle piece 7 may also be formed of a plurality of individual L-shaped angle pieces which are distributed over the width of the side wall in a distance from each other and mounted in the above described manner.

An affixing means formed as a velcro-fastening or grip fastener strip 13 for affixing the ironing cloth is provided at the side 12 opposite to the edge 6. The term "Velcro-fastening" will be used in the following to define a detachable connection between a first strip having a plurality of small elastic hooks and a second strip having a plurality of small loops such that the frst strip releasably adheres to the second strip by an engagement of the hooks with the loops formed by pressing both strips together. Preferably, the velcro-fastening strip 13 is mounted at the underside 15 adjacent to the vertical side wall 14 in the manner shown in FIG. 3 and substantially extends over the entire length of the table surface 2.

The ironing cloth is shown in FIG. 4 in scaled-down representation. The ironing cloth has a hollow seam or hem at a first longitudinal side 16. A rectangular holder 18 or keeper bar which may for example be formed as a wooden rod is inserted into the hollow seam. The width of the holder 18 is selected such that it just fits into the hollow seam and may be just slipped into the groove 11 together with the hollow seam in the manner shown in FIG. 2. By means of the resulting snug fit and the fact that the groove and the table surface include an angle of about 90° it is achieved that the holder 18 is retained in the groove.

A Velcro-fastening strip or hook-fastening strip 20 which extends substantially over the entire length of the ironing cloth is fixed at the edge of the ironing cloth at the second longitudinal side 19 opposite to the first longitudinal side. The distance between the holder 18 inserted in the hollow seam 17 and the Velcro-fastening strip 20 is selected such that with the holder within the hollow seam being inserted in the groove 11 the ironing cloth 5 may be drawn in the manner shown in FIGS. 1 and 2 across the entire table surface 2 and therebeyond by such an extent that the velcro-fastening strip 20 of the ironing cloth obtains a position above the velcro-fastening strip 13 of the ironing table just at the moment when the ironing cloth is correctly tightened. In the above described preferred embodiment the ironing cloth is fed across the table surface 2 and the adjacing side wall 14 down to the underside 15. Additional frictions which further stabilize the position of the ironing cloth result from the deflection over the two edges 21 and 22 between the table surface and the side wall 14 and the side wall 14 and the underside 15, respectively.

As shown in the drawings the ironing cloth may additionally comprise Velcro-fastening strips or hook-fastening strips 25, 26 at the opposite lateral edges 23, 24 thereof. In this case corresponding Velcro-fastening strips or hook-fastening strips 28 are provided at the side walls 27 of the ironing table adjacing the table surface. In stretching out the ironing cloth the Velcro-fastening strips 25, 26 come to rest on top of the Velcro-fastening strips 28 such that they fix the ironing cloth in a manner tensioned in the lateral direction by means of Velcro-fastening connection.

The modified embodiment shown in FIG. 5 differs by the design of the means for engaging the first lateral edge 16 of the ironing cloth 5. In this embodiment the groove 11 is formed by extending the perforated metal sheet 3 beyond the edge 6 and bending the perforated metal sheet downwards in a distance from the edge 6 in an angle such that the downwardly bent part 29 of the perforated metal sheet cooperates with the side wall 9 to form the groove 11. The bending is formed in such a distance from the edge 6 that a groove having the above described width is formed.

In this embodiment the ironing cloth with the hollow seam 17 containing the holder 18 is inserted from below in the manner shown in FIG. 5. Then the ironing cloth is drawn from below across the outer side of the part 29 towards the ironing surface and thereupon in the above described manner. It is the advantage of this embodiment that the L-shaped angle piece may be produced in a particularly simple manner.

According to the invention the engaging means for engaging the first lateral edge 16 may be also formed by a Velcro-fastening strip fixed along the edge 16 of the ironing cloth and a corresponding Velcro-fastening strip attached to the side wall 9 of the ironing table 1. In this case the smooth stretching of the ironing cloth is improved by the deflection of the ironing cloth around the edge of the ironing table between the ironing surface 2 and the side wall 9.

It should be understood that the above description is in no way limitative and that many modifications may be brought to the embodiments disclosed without departing from the true spirit of the invention.

What is claimed is:

1. An ironing table comprising a table surface, and a mounting for an ironing cloth to be stretched thereacross, said ironing cloth having a first lateral edge and an opposite second lateral edge, said mounting comprising engaging means for engaging said first lateral edge of said ironing cloth, said engaging means being located at a first side of said table surface, and an affixing means for affixing said opposite second lateral edge of said ironing cloth, said affixing means being located at a second side of said ironing table which is opposite to and in spaced parallel relationship to said first side, said first engaging means at said first side of the table defining an elongate, rectilinear groove parallel to said first side and a rigid keeper bar corresponding to substantially the cross section of the groove disposed in the groove with an end of the cloth looped about it to thus anchor said first lateral edge of the cloth, and said affixing means comprising a first securing element at said second side of the table disposed in a downwardly-facing position at the underside of the table and a second securing element attached to the underside of the cloth at the second lateral edge in an upwardly-facing position, said securing elements being releasably interengageable by application of pressure to hold the cloth taut between its ends.

2. An ironing table according to claim 1 wherein said groove is of rectangular cross section and has an upwardly-facing open side for receiving said rigid keeper bar.

3. An ironing table according to claim 2 wherein said keeper bar is of rectangular cross section and dimensioned to be press-fitted into the groove with an end of the cloth wrapped about it.

4. An ironing table according to claim 2 wherein said cloth has at said one end a hem defining a passage transversely thereof for receiving said keeper bar.

5. An ironing table according to claim 1 wherein said groove is of rectangular cross section and has a downwardly-facing open side.

6. An ironing table according to claim 5 wherein the keeper bar is of rectangular cross section and dimensioned to be press-fitted into the downwardly-open side of the groove with the end of the cloth wrapped about it.

7. An ironing table according to claim 1 wherein said first and second attaching elements are complementary strips of Velcro.

8. An ironing table according to claim 1 wherein said first engaging means at said first side of the table is an L-shaped angle piece with its short leg perpendicular to a side wall of said table and its long leg spaced from and parallel to the wall.

9. An ironing table according to claim 1 comprising means for fastening a third and fourth edge of the cloth to the sides of the table.

10. An ironing table according to claim 9 wherein said means comprise mating strips of Velcro.

11. An ironing table according to claim 1 wherein a perforated metal sheet is disposed on the table surface with one end bent downwardly at substantially right angles to the surface of the table and spaced from said first side of the table at a distance to define said groove.

* * * * *